US005165680A

United States Patent [19]

Cass

[11] Patent Number: 5,165,680

[45] Date of Patent: Nov. 24, 1992

[54] BASKETBALL PRACTICE DEVICE

[76] Inventor: Norman A. Cass, 54 Foster Rd., Southwick, Mass. 01077

[21] Appl. No.: 596,713

[22] Filed: Oct. 10, 1990

Related U.S. Application Data

[63] Continuation-in-part of Ser. No. 114,391, Dec. 30, 1987.

[51] Int. Cl.[5] ..... A63B 69/00

[52] U.S. Cl. ..... 273/1.5 A

[58] Field of Search ..... 273/1.5 A; D21/201

[56] References Cited

U.S. PATENT DOCUMENTS

| | | | |
|---|---|---|---|
| 1,765,269 | 6/1930 | Hatley | 273/1.5 A |
| 3,799,543 | 3/1974 | Steele, Jr. | 273/1.5 A |
| 3,814,421 | 6/1974 | Spier, Jr. | 273/396 X |
| 3,945,638 | 3/1976 | Luebkeman | 273/1.5 A |
| 4,720,101 | 1/1988 | Farkas, Jr. | 273/1.5 A |
| 4,836,539 | 6/1989 | Knapp | 273/1.5 A |
| 4,896,882 | 1/1990 | Coleman | 273/1.5 A |
| 4,936,577 | 6/1990 | Kington et al. | 273/1.5 A |

OTHER PUBLICATIONS

Boston Celtics Pride, vol. 3, Issue 5, No. 45, 1-1988, p. 21, Cass U.S.A. Shootout.

*Primary Examiner*—Paul E. Shapiro

[57] ABSTRACT

A game of basketball designed to assist the player in practice shooting from various positions around the existing basketball hoop assembly and return the ball to the player after completing a basket, thus enabling the player more shooting and less time retrieving the ball.

1 Claim, 6 Drawing Sheets

BASKETBALL PRACTICE DEVICE

CROSS-REFERENCE

This application is a continuation-in-part of application Ser. No. 07/114,391, filed Dec. 30, 1987.

BACKGROUND

This invention relates to the game of basketball and is designed to assist the player in practice shooting from various positions around the existing basketball hoop assembly and return the ball to the player after completing a basket, thus enabling the player more shooting and less time retrieving the ball.

SUMMARY

The basketball practice device of the invention consists of a curved top unit made of steel tubing and basketball netting designed to accommodate the ball and direct it the existing basketball hoop. The top unit is particularly useful when the player is practicing shooting from positions other than the foul line.

A lower unit is attached to the top unit by two brackets and is funnel shaped and curved to control the direction of the ball to be returned to the player. The lower unit also consists of webbing, similar to that used on trampolines, to increase the rebound speed of the ball upon exiting the chute.

DESCRIPTION OF THE PREFERRED EMBODIMENT

Figure 1:
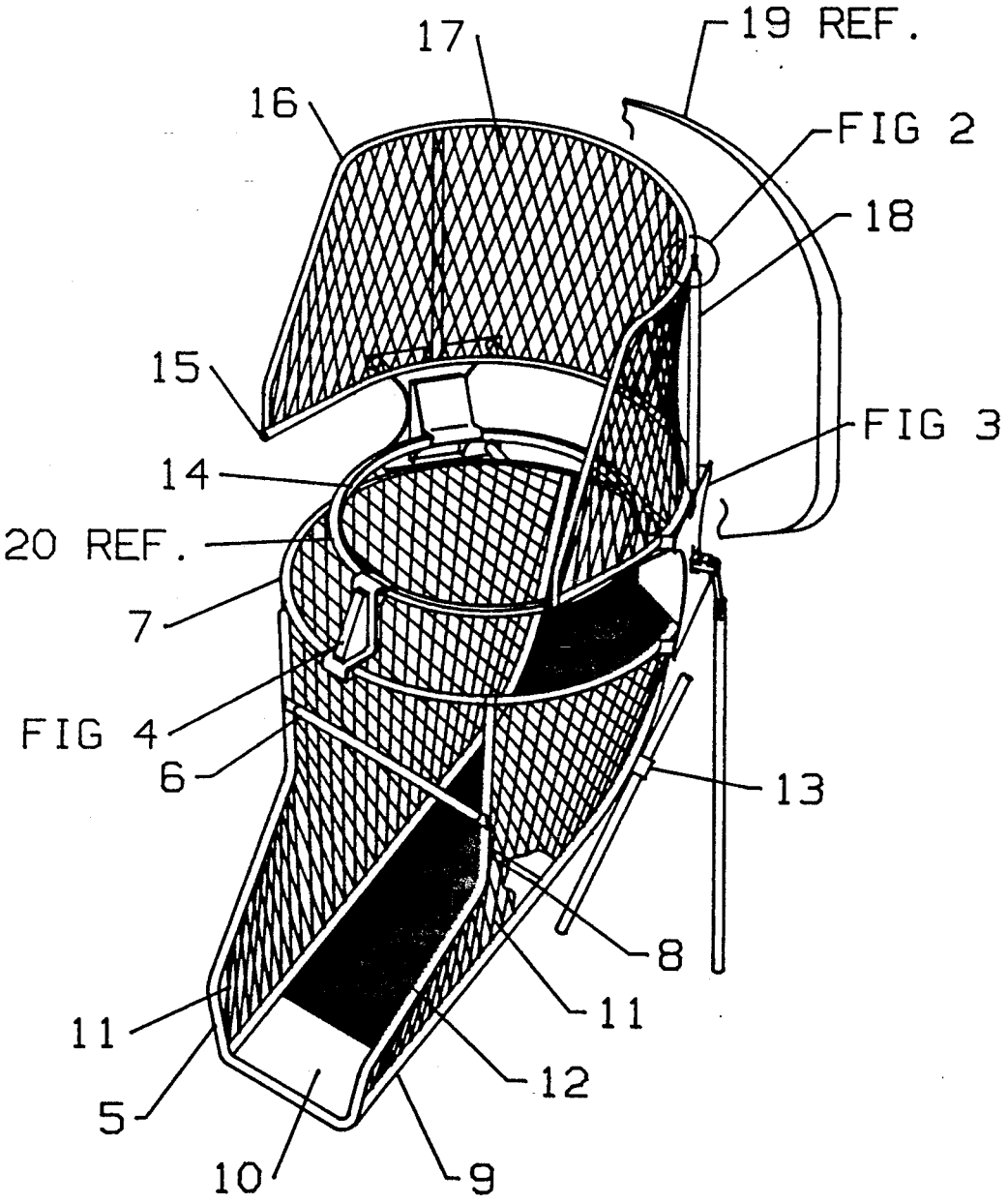
FIG. 1 is a perspective view of the Practice Device mounted on a standard basketball hoop and backboard.

As shown in FIG. 1, an upper unit (15 thru 18) and a lower unit (5 thru 13) have basketball netting (11 & 17) attached to the tubular frames to control the return of the ball to the player. Also a bottom trampoline type webbing (12) is attached to the two inner tubes and plastic exit ramp (10) to assist in the rebound speed of the ball being returned to the player.

Figure 2:
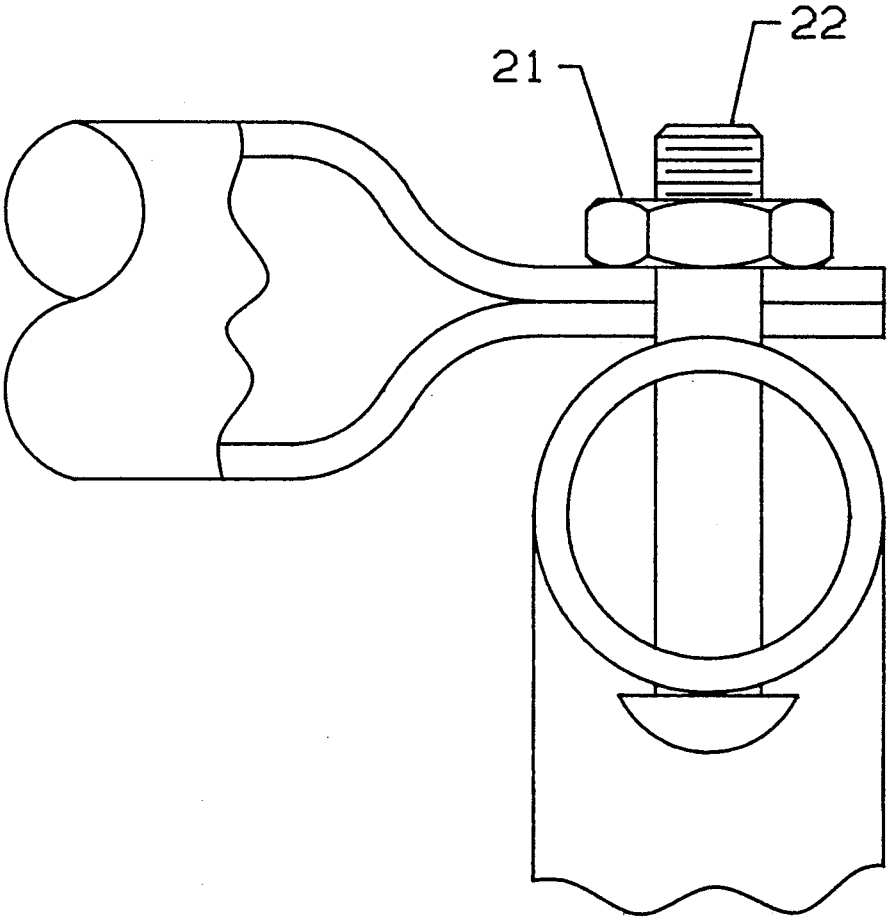
FIG. 2 is a sectional view of the fastening device used to assemble the tubular frame of the upper and lower units.

The type of assembly shown in FIG. 2 is recommended for reduced packaging size. As an optional method of construction, welding of the tubular units may be considered.

Figure 3:
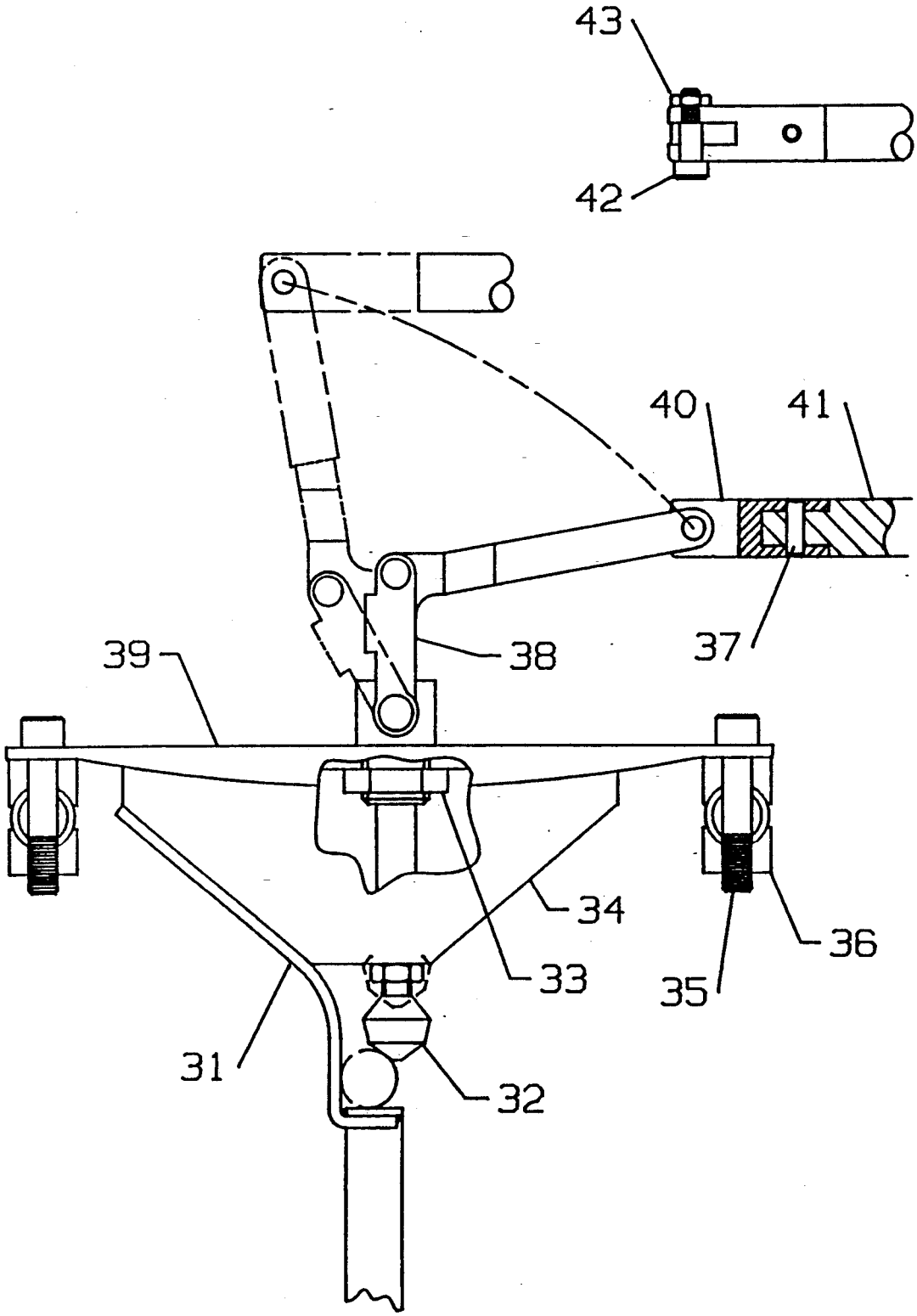
FIG. 3 is a side view of the side support bracket assembly.
Figure 3A:
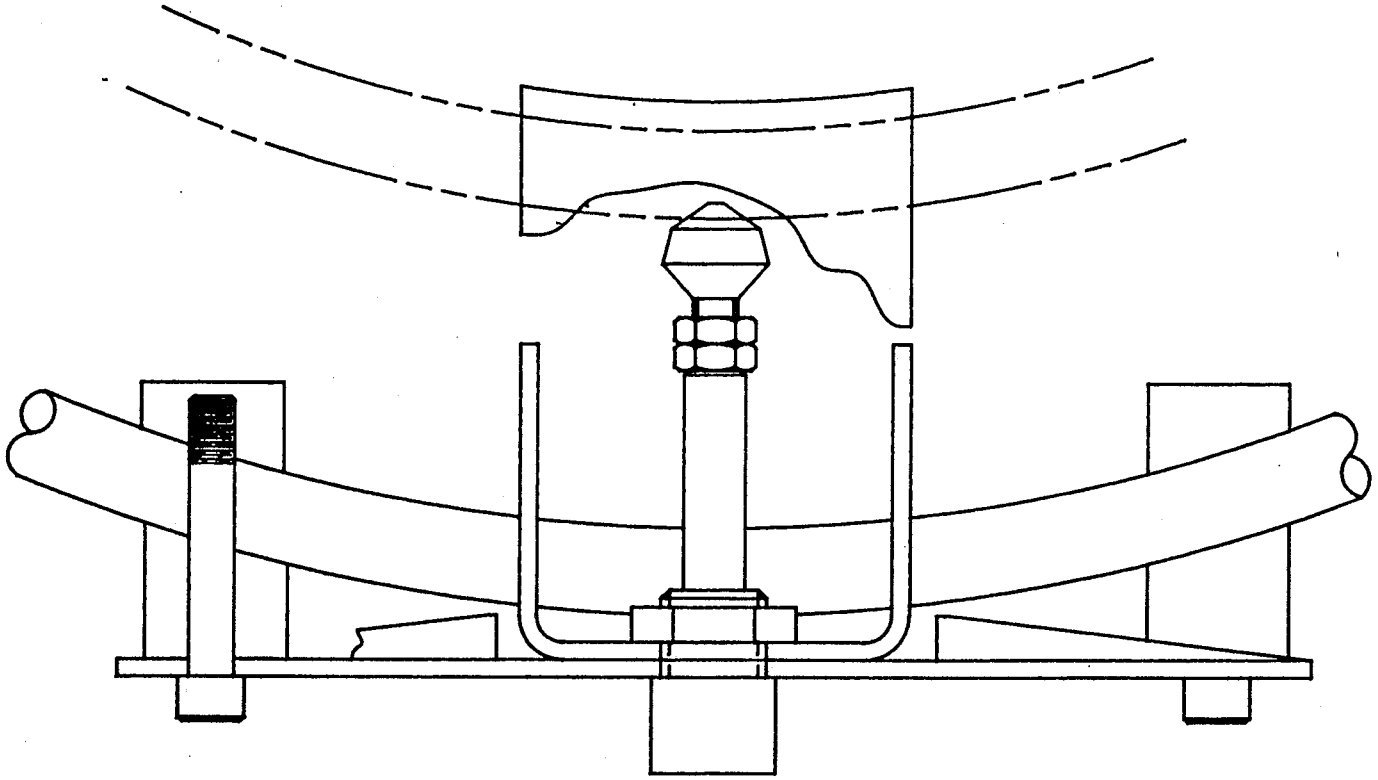
FIG. 3A is a top view part in section of the side support bracket.

As shown in FIG. 3, the bracket (39) is a steel and or aluminum welded construction with concave sides to allow rotation of the Practice Device on an existing hoop (20) (see FIG. 1). The inside of the bracket (39) consists of a "U" shaped support (34) and top angle plate (31) used to support the Practice Device on the rim of a basketball hoop (20). In the center of the support bracket a commercial clamping device (38) has been attached by means of a jam nut (33). The commercial clamp device (38) has been modified by attaching a clevice (40) to the handle with a shoulder screw (42). Also a nylon extension (41) has been attached to the clevice (40) with a pressed pin (37). This support bracket (39) is assembled to the upper tube unit (15 thru 18) and lower tube unit (5 thru 13) with nylon spacers (36) on the outside of the assembly and smaller nylon spacers (36) on the inside of the assembly which are threaded to accept a button head screw (35).

Figure 4:
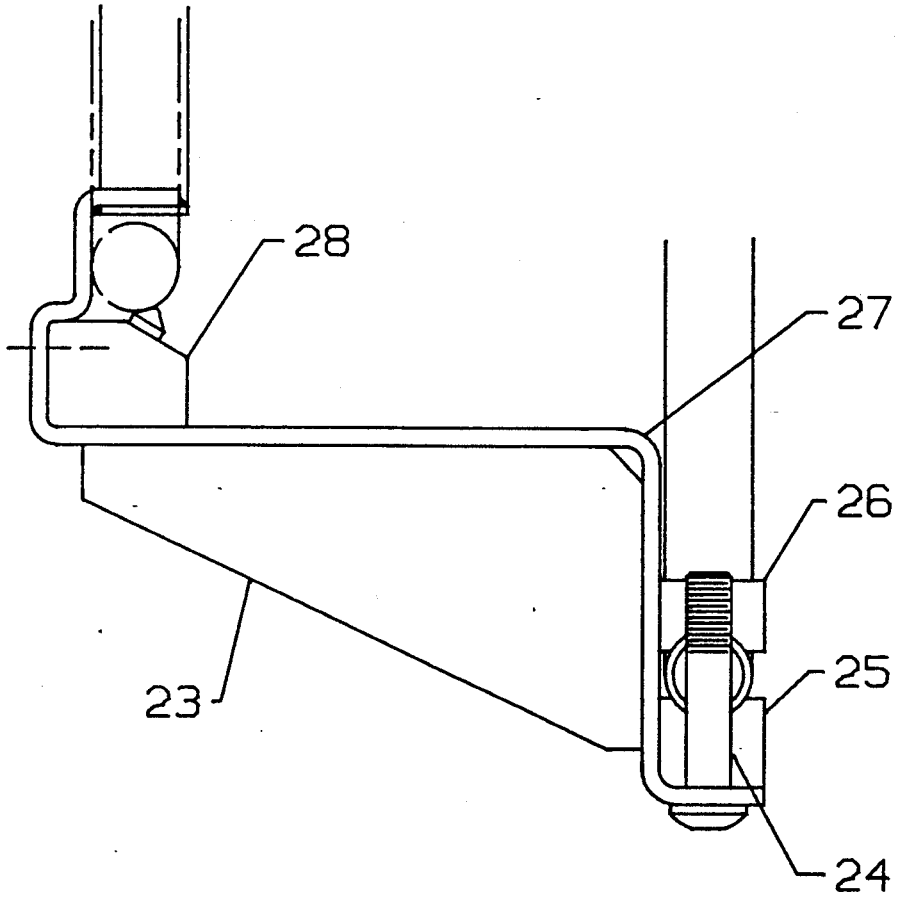
FIG. 4 is a side view of the front support bracket.
Figure 5:
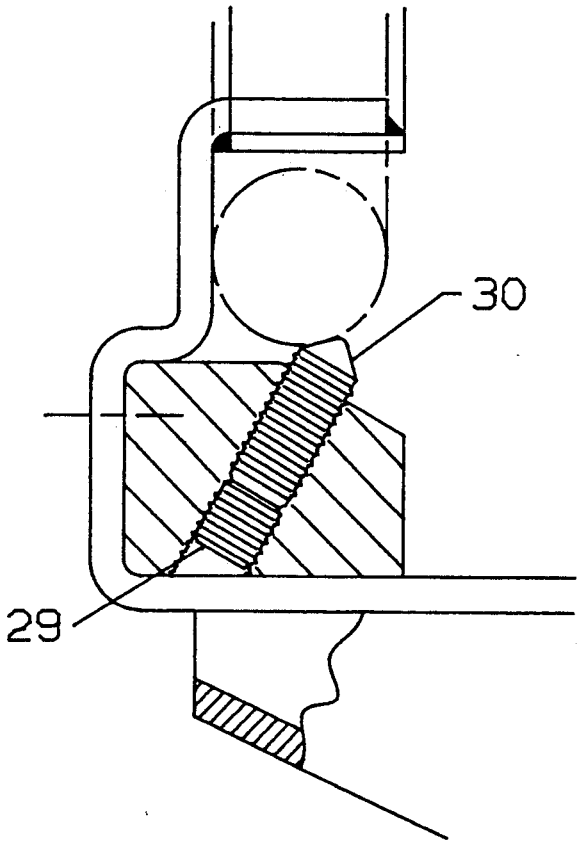
FIG. 5 is a sectional side view of the front bracket.

FIG. 4 shows the front support bracket (27) which is also a steel and or aluminum welded construction, for strength and rigidity. A cone shaped set screw (30) protrudes through to the inside of the bracket to pinch the ring of the existing basketball hoop when the two clamps (38) are extended against the above ring preventing the Practice Device from lifting up from the existing basketball hoop during the period of practice shooting.

DETAILED DESCRIPTION OF METHOD OF ASSEMBLY

The basketball practice device of this invention can be attached to any standard basketball hoop, clamped and positioned to suit the players shooting position, as follows:

A) Lift the device to align the existing basketball hoop (20) below the guide ring (14), attached to the support brackets (27) and (39), and slide the assembly towards the back of the existing hoop (20), while raising the guide ring (14) on the existing hoop (20).

B) Continue to slide the unit until the guide ring (14) drops inside the existing hoop (20). Once seated the PRACTICE DEVICE can be rotated to the left or right inside of the existing hoop (20) and clamped.

C) To clamp the PRACTICE DEVICE to the existing hoop (20), pull down on the nylon rods, attached to the clamp mechanisms (38), until the clamp lever locks.

D) As the clamp lever (38) is pulled down it extends a neoprene tipped plunger to pinch the existing hoop (20) to support brackets (31).

E) The nylon clamp rod can now be secured in the retaining clips (13) attached to the frame (9).

F) The front bracket has a cone point set screw (30) to wedge the existing hoop (20) against the front bracket as the two clamp mechanisms (38) pull the PRACTICE DEVICE toward the back of the hoop, thus securing the PRACTICE DEVICE at three points around the existing hoop (20).

G) To remove the PRACTICE DEVICE and or change the position of rotation, release the nylon rods (41) from the spring retaining clips (13) and push upward to retract the neoprene tipped plungers (32). The PRACTICE DEVICE is now free to remove, by lifting the assembly up to clear the guide ring (14) and move forward from the existing hoop (20), also the assembly can be rotated to the left or right and reclamped, by pulling down the nylon rods, for different radial shooting positions.

I claim:

1. A basketball return device, for attachment to a basketball goal having a vertical backboard and a horizontal circular hoop, comprising:

a) a lower unit comprising;

1) a main ring having a diameter greater than said hoop adapted to be positioned below said hoop;

2) a return chute depending from said main ring, said return chute comprising spaced skeletal side frames, netting material secured to the side of said main ring and skeletal side frames forming two spaced side walls of said chute and resilient material secured to the rear of said main ring and between said frames forming a downwardly and forwardly curved rear-bottom chute wall;

3) at least three upwardly and inwardly extending brackets secured to said main ring, said brackets each having an inverted U-shape hook at the inner-upper ends thereof for hooking over said hoop;

4) a guide ring having an outside diameter substantially the same as the inside diameter of said hoop secured to said hooks and adapted to be positioned within said hoop; and 5) means for clamping said lower unit to said hoop against removal and rotation; and b) an upper unit comprising;

1) a generally semi-cylindrical skeletal framework and netting filling said framework to form a general semi-cylindrical wall; and 2) means securing said wall to said lower unit with the lower edge of said wall spaced above said guide ring, and generally vertically aligned with the side and rear walls of said return chute, c) whereby said device may be slipped over said hoop, with the guide ring positioned in said hoop, the return chute suspended from the hoop and the upper unit wall positioned above and partially surrounding the hoop, rotated so the return chute discharges balls in a desired direction toward a shooter, and clamped into position, so that balls thrown towards the hoop will be directed into the hoop by the upper unit wall and returned to the thrower by the return chute.

* * * * *